United States Patent [19]

Bogaczyk et al.

[11] Patent Number: 4,467,976

[45] Date of Patent: Aug. 28, 1984

[54] RIBBON CARTRIDGE COMPRISING A STUFFER BOX INTERMEDIATE A SUPPLY REEL AND TAKE-UP REEL

[75] Inventors: Francis W. Bogaczyk; Richard C. Croll; Billy D. Purcell; Edward E. Toutant, all of Austin, Tex.

[73] Assignee: International Business Machines Corporation, Armonk, N.Y.

[21] Appl. No.: 432,585

[22] Filed: Oct. 4, 1982

[51] Int. Cl.[3] ..... B65H 17/02

[52] U.S. Cl. ..... 242/67.3 R; 242/194; 400/196.1; 400/208

[58] Field of Search ..... 242/194, 193, 199, 200, 242/67.3 R, 71.2; 400/207, 208, 208.1, 196.1; 226/118, 119

[56] References Cited

U.S. PATENT DOCUMENTS

| | | | |
|---|---|---|---|
| 2,756,940 | 7/1956 | Lessler | 242/71.2 |
| 2,889,908 | 6/1959 | Korner . | |
| 2,972,402 | 2/1961 | Howard . | |
| 2,991,920 | 7/1961 | Emslie et al. | 226/118 |
| 3,185,400 | 5/1965 | Maxey | 226/119 X |
| 3,203,607 | 8/1965 | Mason | 226/119 |
| 4,252,450 | 2/1981 | Goodman et al. | 400/208 |
| 4,279,390 | 7/1981 | Wu et al. | 242/194 |
| 4,300,847 | 11/1981 | Hoffman et al. | 400/196.1 |

FOREIGN PATENT DOCUMENTS

| | | | |
|---|---|---|---|
| 1439901 | 6/1976 | United Kingdom | 400/207 |

OTHER PUBLICATIONS

IBM Technical Disclosure Bulletin, vol. 25, No. 1, Jun. 1982, pp. 276–277.

*IBM Technical Disclosure Bulletin,* "Printer Ribbon Stuffer Box with Unique Exit Slot, " W. Goff, Jr., Feb. 1980, p. 3905.

*IBM Technical Disclosure Bulletin,* "Printer Ribbon Cassette," P. A. Brumbaugh et al., Jan. 1977, p. 2978.

*Primary Examiner*—John M. Jillions

*Attorney, Agent, or Firm*—J. B. Kraft

[57] ABSTRACT

A ribbon cartridge comprising a cartridge housing having take-up and supply reels rotatably mounted in the housing; each reel supports a portion of a ribbon web running in a path from the supply to the take-up reel in combination with a ribbon stuffer box disposed along the path of the ribbon between the supply and take-up reel whereby the ribbon running between these two reels passes through the stuffer box.

11 Claims, 3 Drawing Figures

RIBBON CARTRIDGE COMPRISING A STUFFER BOX INTERMEDIATE A SUPPLY REEL AND TAKE-UP REEL

DESCRIPTION

1. Background of Invention

This invention relates to printers with high ribbon usage. More specifically, it relates to a ribbon feed and ribbon drive apparatus for such printers having movable carriers.

It has been about twenty-five years since the impact printer-typewriter technology began using a movable carrier containing the impact printer characters along a stationary platen supporting the medium to be printed upon. This was a breakthrough which drastically simplified impact printing operations and opened the door to high speed impact printing. In the ensuing years, during which movable carrier impact printers and typewriters have achieved universal acceptance, substantially every commercially practical impact printer has the ribbon and ribbon drive mechanism mounted upon and carried along by the movable carrier. The primary reason for maintaining the ribbon and ribbon drive on the carrier was that with such an arrangement the ribbon would only have to traverse a relatively short distance when running from the supply to the take-up reel. In addition the movable carrier has provided for a relatively compact and light printer which is not cumbersome or bulky and physically easily fits into a general office system environment.

While the ribbon and ribbon drive mechanism which is on the carrier has shown the above advantages, advancing printer technology has presented new demands and problems in the art. With increasing speeds of printers, there has been a need for increased ribbon supplies, i.e., the amount of ribbon available before a change in the ribbon cartridge is necessary. Because of the high throughput of such high speed printing apparatus and consequently the high volume of printed characters, ribbon is used up quite rapidly. Consequently, it would be very desirable to increase the ribbon supply available. Another problem is brought about by the use in the high speed printing technology of ribbons that produce high print quality, but which are highly distortable and fragile. Because of the great amount of ribbon used, the technology has had to provide a relatively low cost high print quality ribbon. In meeting this requirement, the art has generally replaced the more traditional low quality fabric based ribbons with a ribbon which is a cast matrix of plastic such as nylon containing a liquid ink. While these ribbons produce high quality printing at low cost, they are highly distortable and fragile. The problem presented by such fragile ribbons is how to maintain a constant uniform tension required for good printing and tracking, i.e., maintaining ribbon in a relatively taut condition in the printing area while at the same time driving the ribbon without substantially distorting or breaking the highly distortable fragile ribbon.

In this connection, another substantial problem is presented. Simple axial take-up spool devices if driven by the conventional constant angular drives provided by stepper motors result in ribbon feed rates at the print point which increase as the take-up reel's diameter increases. This results in less than optimum ribbon utilization. Conventionally, capstan drive rollers have been used to linearize this feed rate. But they require a clutch to vary the take-up reel's angular rate. Conventional clutches utilize coulomb friction, controlled ribbon tension and tracking restraints that add a measure of unreliability to the system, particularly when the above described fragile ribbons are being used. In other words, such frictional clutch systems may result in undesirable breaking of the fragile ribbons. Other clutch systems such as magnetic clutches have been considered in place of the frictional clutches. However, these represent a very substantial increase in cost which is undesirable in a highly competitive printer industry. Alternatively, peripheral take-up reel drives may be utilized to optimize ribbon utilization since such peripheral drives maintain a constant take-up velocity irrespective of the constantly increasing diameter of the take-up reel. However, such peripheral drives by their very nature consume room on the periphery of the take-up reel thereby consuming valuable space which could otherwise be used to store more ribbon in the unit.

In view of the foregoing, there is a need in the art for a ribbon cartridge mechanism with a relatively large supply of ribbon which is relatively light in weight and small in size and has the further capability of maintaining constant ribbon tension in the printing area for a relatively fragile ribbon. The ribbon cartridge structure of the present invention provides an apparatus having a combination of all of the above advantageous characteristics. As will be described hereinafter in greater detail, the present invention utilizes supply and take-up reels in combination with a stuffer box structure disposed along the path of the ribbon between the supply and take-up reels. The stuffer box is used as a ribbon reservoir to compensate for differences in the peripheral speeds of the ribbon reels thereby eliminating the need for a clutch.

2. Background Art

By way of background art, *IBM Technical Disclosure Bulletin* publications "Printer Ribbon Stuffer Box with Unique Exit Slot", W. Goff, Jr., February 1980 and "Printer Ribbon Cassette", P. A. Brumbaugh et al, January 1977 disclose stuffer box structures used for ribbon supply. U.S. Pat. No. 4,300,847 also utilizes such a stuffer box structure for a ribbon supply. However, none of this prior art teaches a structure having a stuffer box supply between a ribbon supply reel and a ribbon take-up reel.

U.S. Pat. Nos. 2,972,402 and 2,889,908 disclose ribbon feed mechanisms with coaxial take-up and supply reels. However, neither of these references utilizes stuffer boxes for any purpose in combination with these take-up and supply reels.

DISCLOSURE OF THE PRESENT INVENTION

As indicated hereinabove, the present invention provides a ribbon cartridge accommodating a large ribbon supply with the capability of maintaining a constant feed rate and ribbon tension in the printing area irrespective of changes in the peripheral speed of the ribbon portion on the take-up reel resulting from variations in diameter of the ribbon on that take-up reel. The present ribbon cartridge has a housing, with take-up and supply reels mounted in the housing, each reel supporting a portion of the ribbon web which runs in a path from the supply reel to the take-up reel traversing the printing position of the printer. The ribbon stuffer box is disposed along the path of ribbon between the supply and take-up reels whereby ribbon running between these reels passes through the stuffer box. This stuffer box serves as a reservoir to compensate for changes in the peripheral speed of the two reels.

For example, as will later be described in detail, when the ribbon is unused and the diameter of the ribbon on the take-up reel is small, more ribbon is stuffed into the box than is pulled out of the box by the take-up reel. During this period, increasing amounts of ribbon become "buffered" in the stuffer box until the diameter of the ribbon on the take-up reel becomes large enough to pull more out of the box than is stuffed in. As ribbon usage continues, the "buffered" ribbon in the box becomes more depleted until the box is voided. The cartridge is then discarded, and a new one installed.

BRIEF DESCRIPTION OF THE DRAWINGS

Referring now to the drawings, wherein a preferred embodiment of the invention is illustrated, and wherein like reference numerals are used throughout to designate like parts.

BEST MODE FOR CARRYING OUT THE INVENTION

Figure 1:
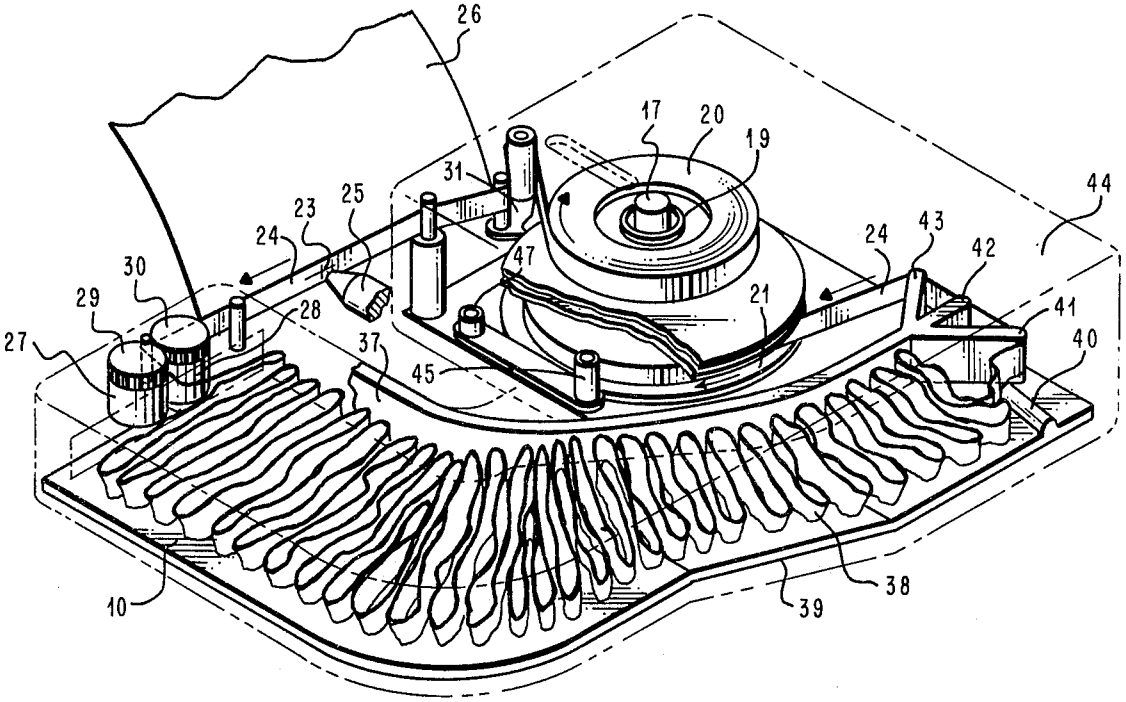
FIG. 1 is an isometric diagrammatic illustration of the ribbon cartridge in accordance with the present invention with appropriate portions of the cartridge housing broken away and sections of the structure broken away so as to more clearly show the apparatus of the present invention.
Figure 2:
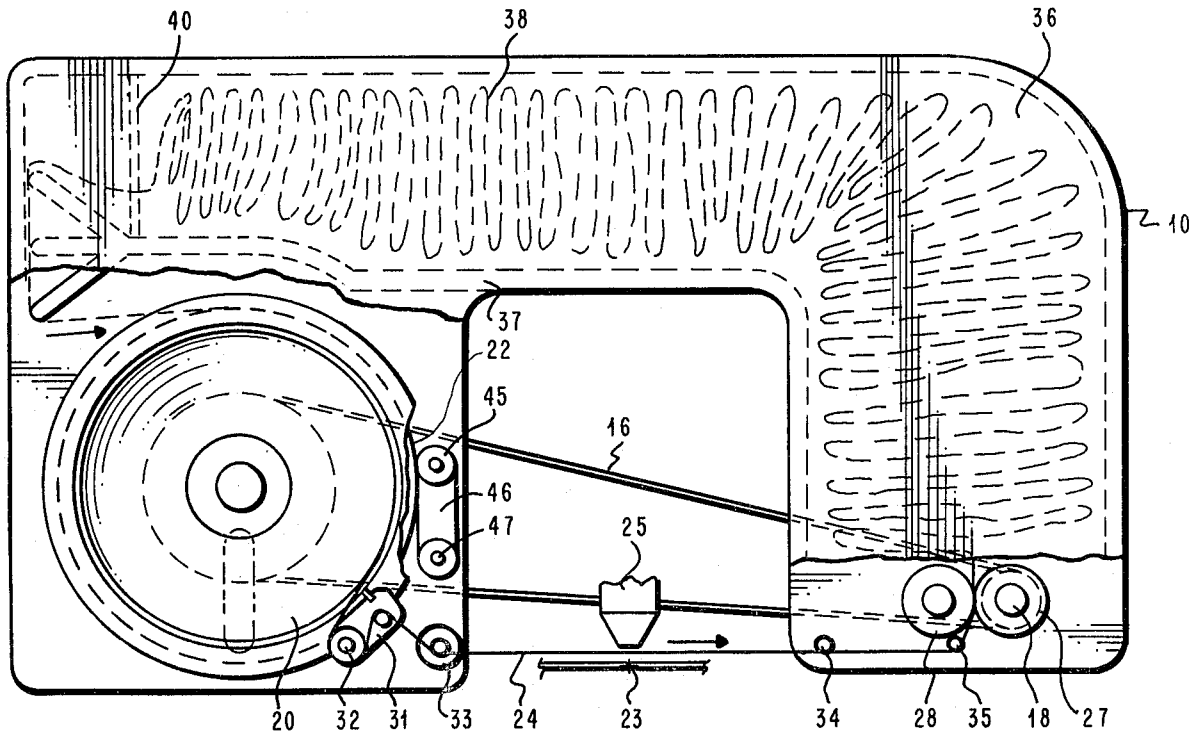
FIG. 2 is a plan view of the structure of FIG. 1 with the top of the housing partially removed so as to illustrate the mechanism of the present invention.
Figure 3:
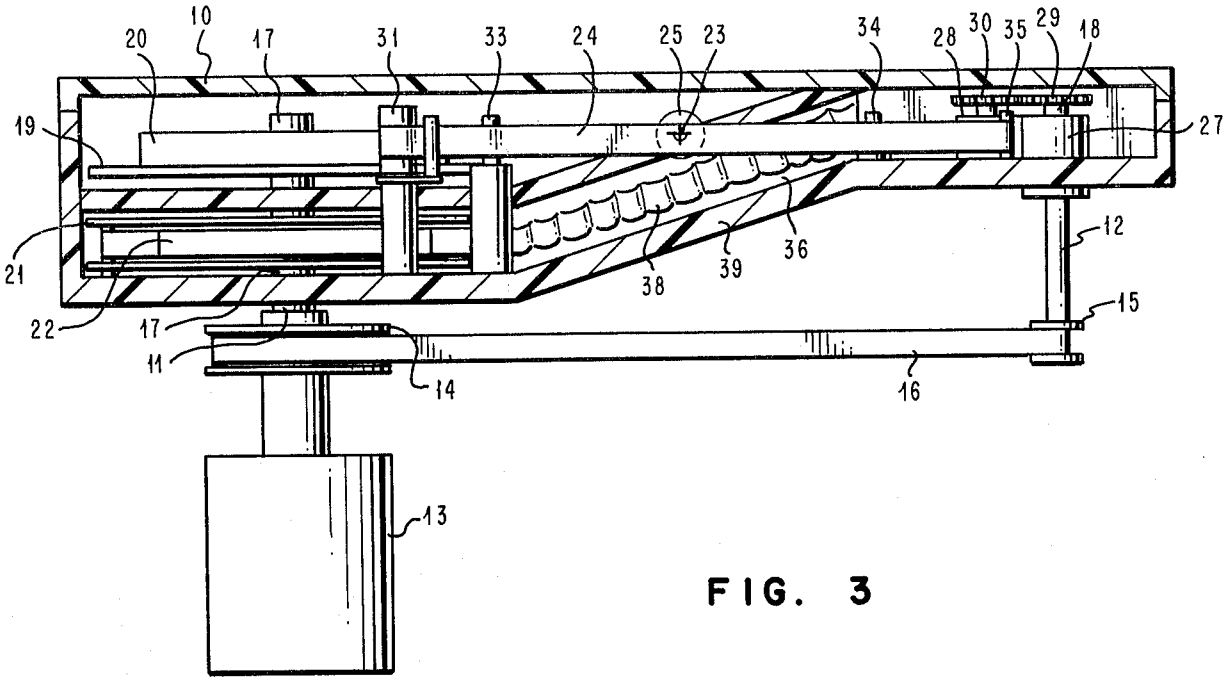
FIG. 3 is a front view of the cartridge of the present invention mounted upon a suitable drive mechanism in the printer.

With reference to FIGS. 1, 2 and 3, the preferred embodiment of the present invention illustrated by these figures will now be described. Cartridge housing 10 is seated on and engages a pair of shafts 11 and 12 in the ribbon drive mechanism of the printer. This is best illustrated in FIG. 3. A suitable drive means in the printer such as stepper motor 13 rotates shaft 11 and through a belt and pulley system involving pulleys 14 and 15 and belt 16 also rotates shaft 12. A selected rotational speed differential is provided between shafts 11 and 12 through the relative diameters of pulleys 14 and 15.

Through conventional coupling mechanisms not shown in detail, cartridge 10 is so received and positioned when received with respect to the printer that drive shafts 11 and 12 of the printer drive mechanism respectively connect with and drive shafts 17 and 18 in the cartridge. The respective couplings between shafts 11 and 17 and 12 and 18 may be any conventional coupling mechanism.

Supply reel 19 contains the ribbon supply 20. Supply reel 19 is mounted on shaft 17 so as to be freely rotatable about this shaft. On the other hand, take-up reel 21 is affixed to shaft 17 whereby the rotation of driven shaft 17 also rotates take-up ribbon portion 22 on take-up reel 21.

Ribbon 24 is moving from supply portion 20 to take-up portion 22 follows a path which takes it past print point 23 where a printhead mechanism 25 shown in a generalized diagrammatic form drives ribbon 24 against the document 26 to be printed upon.

Printhead 25 may be any conventional printer head such as a wire matrix printhead or it may be an impact printer printhead such as a missile or hammer in which case the missile or hammer would have to be used in combination with a conventional daisy wheel type of printwheel containing the characters to be printed.

Ribbon supply is metered off supply reel 19 by mating capstan roller 27 and idler roller 28. Capstan roller 27 is affixed to shaft 18 which is driven by stepper motor 13 via pulleys 14 and 15, belt 16 and shaft 12. Gear paths 29 and 30 act to rotate idler 28 together with capstan 27. The combination of capstan 27 and idler 28 act to draw ribbon 24 from supply portion 20 on reel 19. As the ribbon is taken off supply portion 20, it passes over pawl 31 which is spring loaded by means not shown so as to be biased in a counterclockwise direction about pivot 32. Thus, when ribbon 24 is drawn in the direction shown by capstan 27 and idler 28 across guide posts 33, 34 and 35, the motion of the ribbon acts to pivot pawl 31 in a clockwise direction about pivot 32 to oppose counterclockwise spring loading of that pawl and thus maintain a constant tension on ribbon 24 at print point 23. Upon emerging from between capstan 27 and idler 28, the ribbon is then pushed into stuffer box reservoir 36 formed within the walls of housing 10 including internal wall 37. By way of illustration, the folded ribbon portion 38 within stuffer reservoir 36 may constitute on the order of 5 to 15 percent of the total ribbon length in the cartridge. It should be noted that stuffer box reservoir 36 has a ramp portion 39 best seen in FIG. 3 along which the ribbon descends from an upper level to a lower level, the latter being at the same level as take-up reel 21. The folding of the ribbon into folds 38 is enhanced by a lip or dam 40 near the exit end of stuffer box 36. The forward motion given to the ribbon by capstan 27 and idler 28 ribbon metering rollers is not sufficient to force the ribbon over ridge 40. Thus, the ribbon backs up and in effect forms the folds in the stuffer reservoir 36. In order to remove ribbon from this stuffer box reservoir 36, the ribbon must be drawn from the reservoir over ridge 40 by the action of take-up reel 21. As stated previously take-up reel 21 containing the take-up ribbon portion 22 is affixed to shaft 17 which is driven by stepper motor 13 through shaft 11. Thus, in order to take-up ribbon, shaft 17 is rotated as described. This in turn rotates the take-up ribbon portion 22 which in turn draws the ribbon from reservoir 36 over ridge 40. The separation fingers 41, 42 and 43 around which the ribbon passes form expansion cavities each having a narrow space with the rear wall 44 of cartridge housing 10 thus causing singular webs of ribbon 24 to pass through this narrow space and ensure that the ribbon drawn from stuffer box 36 is free of fold.

In taking up the ribbon, shaft 17 to which take-up reel 21 is affixed is rotated at a constant speed. However, despite this constant speed, the speed at which ribbon is taken-up on take-up portion 22 of take-up reel 21 will vary with the diameter of the take-up ribbon portion 22. When the diameter is relatively small, the speed of the ribbon being taken-up will be relatively low. As the diameter increases, the peripheral speed of ribbon portion 22 and consequently the take-up speed of the ribbon will increase. In this connection, it should be noted that the ribbon being taken-up on the ribbon portion 22 is tightly spooled in place on reel 21 with a minimum of ribbon tension by the action of compression roller 45 which is mounted on compression arm 46, spring urged by spring means not shown in a counterclockwise direction around pivot 47 so as to urge roller 45 against taken-up ribbon portion 22. A major advantage of folded ribbon 38 in stuffer box reservoir 36 is that this ribbon does act as a reservoir and a buffer so that irrespective of varying peripheral speed of the ribbon portion 22 and consequently the take-up speed of the ribbon, the ribbon may still be uniformly removed from supply portion 20 on supply reel 21 through constant velocity capstan 27 and idler 28 and maintained at the same constant tension by means of tensioning pawl 31 at print point 23.

While the invention has been particularly shown and described with reference to a preferred embodiment it will be understood by those skilled in the art that various other changes in form and detail may be made without departing from the spirit and scope of the invention.

We claim:

1. A ribbon cartridge comprising, a cartridge housing, first and second reels rotatably mounted in said housing, each supporting a portion of a ribbon web running in a path from one reel to the other, and a ribbon stuffer box disposed along the path of said ribbon between said first and second reels whereby said ribbon web running between said reels passes through said stuffer box.

2. The ribbon cartridge of claim 1 wherein said first and second reels are mounted on the same hub.

3. The ribbon cartridge of claim 2 wherein said first reel is the ribbon supply reel and is rotatably mounted on said hub.

4. The ribbon cartridge of claim 3 wherein said second reel is the ribbon take-up reel and is fixed to said hub, and said hub is rotatable.

5. The ribbon cartridge of claim 4, further including ribbon metering means for drawing the ribbon from the ribbon supply reel and maintaining the portion of ribbon between said supply reel and said stuffer box under a constant tension.

6. The ribbon cartridge of claim 5 wherein said ribbon metering means include capstan means for driving the ribbon.

7. Printing apparatus in combination with the ribbon cartridge of claim 5 comprising means for receiving and supporting said cartridge, means for driving said ribbon metering means, and means for rotating said hub, whereby said take-up reel draws said ribbon from said stuffer box.

8. The apparatus of claim 5 wherein said supply reel and said take-up reel are mounted on said hub on two different levels and the stuffer box extends from the level of said supply reel to the level of said take-up reel.

9. The apparatus of claim 7 wherein said means for receiving and supporting said cartridge is on a movable carrier in said printing apparatus.

10. The apparatus of claim 9 wherein said cartridge is mounted in such a position on the carrier such that said portion of ribbon under constant tension extends across the printing position in said printer.

11. The apparatus of claim 7 further including a rotatable roller in contact with the periphery of the ribbon on said take-up reel and means for spring biasing said roller against said periphery whereby ribbon may be wound on said take-up reel with minimal tension.

* * * * *

UNITED STATES PATENT AND TRADEMARK OFFICE

CERTIFICATE OF CORRECTION

PATENT NO. : 4,467,976

DATED : August 28, 1984

INVENTOR(S) : F. W. Bogaczyk et al

It is certified that error appears in the above—identified patent and that said Letters Patent is hereby corrected as shown below:

Col. 3, line 60, delete "is", and substitute --in--.

Signed and Sealed this

*Twenty-sixth* Day of *February 1985*

[SEAL]

*Attest:*

DONALD J. QUIGG

*Attesting Officer* *Acting Commissioner of Patents and Trademarks*